US010456000B2

(12) United States Patent
Rukavina

(10) Patent No.: US 10,456,000 B2
(45) Date of Patent: Oct. 29, 2019

(54) SURFACE CLEANING HEAD WITH A VALVE ASSEMBLY

(71) Applicant: Techtronic Industries Co. Ltd., Tsuen Wan, New Territories (CN)

(72) Inventor: Douglas M. Rukavina, Massillon, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 202 days.

(21) Appl. No.: 15/542,967

(22) PCT Filed: Jan. 27, 2016

(86) PCT No.: PCT/US2016/015073
§ 371 (c)(1),
(2) Date: Jul. 12, 2017

(87) PCT Pub. No.: WO2016/123190
PCT Pub. Date: Aug. 4, 2016

(65) Prior Publication Data

US 2018/0020892 A1 Jan. 25, 2018

Related U.S. Application Data

(60) Provisional application No. 62/108,882, filed on Jan. 28, 2015.

(51) Int. Cl.
*A47L 9/04* (2006.01)
*A47L 9/00* (2006.01)
(Continued)

(52) U.S. Cl.
CPC ..... *A47L 9/0422* (2013.01); *A47L 9/0072* (2013.01); *A47L 9/02* (2013.01); *A47L 9/0494* (2013.01);
(Continued)

(58) Field of Classification Search
CPC ..... A47L 9/0422; A47L 9/02; A47L 9/0494; A47L 9/0646; A47L 9/322; A47L 5/24; A47L 5/30
See application file for complete search history.

(56) References Cited

U.S. PATENT DOCUMENTS 4,015,308 A 4/1977 Rickmers
5,634,238 A 6/1997 McCaffrey et al.
(Continued)

FOREIGN PATENT DOCUMENTS

CN 1308915 A 8/2001
CN 101953664 A 1/2011
(Continued)

OTHER PUBLICATIONS

Chinese Patent Office Action for Application No. 201680007782.9 dated Feb. 19, 2019, with English Translation, 8 pages.
(Continued)

*Primary Examiner* — Dung Van Nguyen
(74) *Attorney, Agent, or Firm* — Michael Best & Friedrich LLP

(57) ABSTRACT

A surface cleaning head 100 for a surface cleaning apparatus includes a dirty air inlet 108, a dirty air outlet 112, and a dirty airflow path extending between the dirty air inlet 108 and the dirty air outlet 112. The surface cleaning head 100 also includes an automated valve assembly 116 operable to open and place the dirty airflow path in fluid communication with ambient pressure. The automated valve assembly 116 is adjustably opened based upon a suction level within the dirty airflow path.

11 Claims, 3 Drawing Sheets

(51) Int. Cl.

| | |
|---|---|
| ***A47L 9/32*** | (2006.01) |
| ***A47L 9/06*** | (2006.01) |
| ***A47L 9/02*** | (2006.01) |
| *A47L 5/24* | (2006.01) |
| *A47L 5/30* | (2006.01) |

(52) U.S. Cl.
CPC ..... *A47L 9/0646* (2013.01); *A47L 9/322* (2013.01); *A47L 5/24* (2013.01); *A47L 5/30* (2013.01)

(56) References Cited

U.S. PATENT DOCUMENTS

| | | | | |
|---|---|---|---|---|
| 6,018,845 | A | 2/2000 | Sueki et al. | |
| 6,517,596 | B2 | 2/2003 | Dodson et al. | |
| 7,278,181 | B2 | 10/2007 | Harris et al. | |
| 7,367,085 | B2 | 5/2008 | Bagwell et al. | |
| 7,437,799 | B2 | 10/2008 | Rocke | |
| 7,634,836 | B2 | 12/2009 | Lee | |
| 8,424,157 | B2 * | 4/2013 | Gell | A47L 9/0606 15/400 |
| 9,655,485 | B2 * | 5/2017 | Staf | A47L 9/0072 |
| 9,770,148 | B2 * | 9/2017 | Bosses | A47L 5/30 |
| 2010/0037425 | A1 | 2/2010 | Genn | |
| 2010/0229339 | A1 | 9/2010 | Lambourn | |
| 2010/0029410 | A1 | 11/2010 | Dyson et al. | |
| 2011/0138568 | A1 | 6/2011 | Hsu | |
| 2012/0227211 | A1 | 9/2012 | Hwang et al. | |
| 2016/0256024 | A1 * | 9/2016 | Kettle Aiers | A47L 9/0477 |

FOREIGN PATENT DOCUMENTS

| | | |
|---|---|---|
| GB | 2471920 | 1/2011 |
| JP | 546359 | 1/1979 |
| JP | 10323303 | 12/1998 |

OTHER PUBLICATIONS

International Search Report and Written Opinion for Application No. PCT/US2016/015073 dated Jan. 27, 2016 (11 pages).

* cited by examiner

SURFACE CLEANING HEAD WITH A VALVE ASSEMBLY

CROSS-REFERENCE TO RELATED APPLICATIONS

This application claims priority to U.S. Provisional Patent Application No. 62/108,882 filed on Jan. 28, 2015, the entire contents of which are incorporated herein by reference.

BACKGROUND

The present invention relates to vacuum cleaners, and more particularly to air bleeds on surface cleaning heads for a vacuum cleaner.

SUMMARY

In one embodiment, the invention provides a surface cleaning head for a surface cleaning apparatus including a dirty air inlet, a dirty air outlet, and a dirty airflow path extending between the dirty air inlet and the dirty air outlet. The surface cleaning head also includes an automated valve assembly operable to open and place the dirty airflow path in fluid communication with ambient pressure. The automated valve assembly is adjustably opened based upon a suction level within the dirty airflow path.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
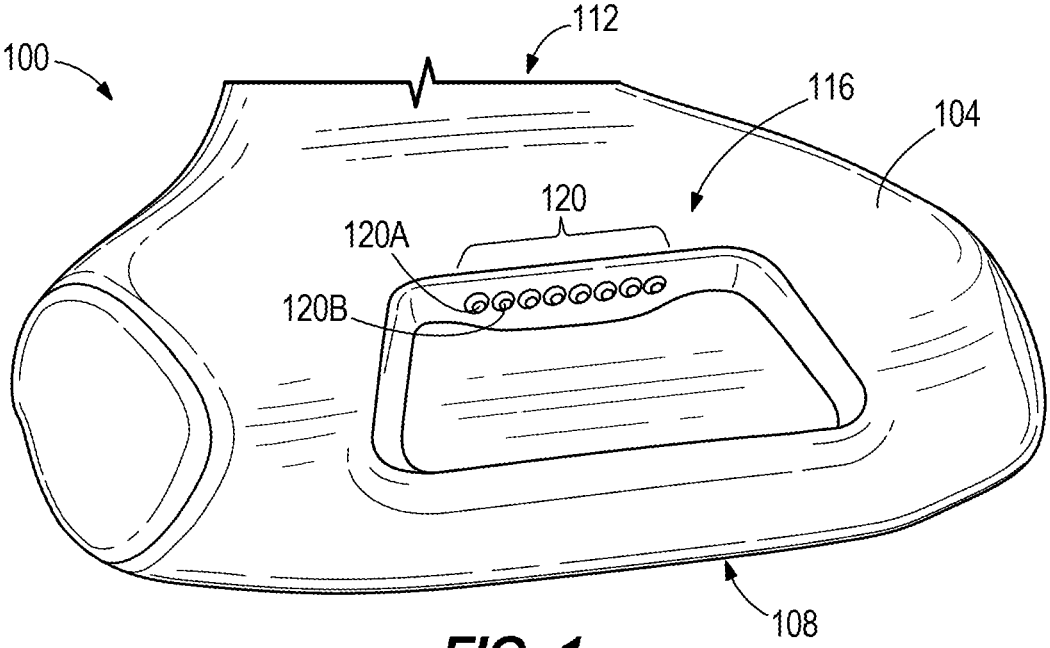
FIG. 1 is a perspective view of a surface cleaning head with an automated valve assembly according to one aspect of the invention.

FIG. 1 illustrates a vacuum cleaner head 100 configured to move along a surface to be cleaned. The illustrated vacuum cleaner head 100 includes a housing 104 with a dirty air inlet 108 and a dirty air outlet 112. A dirty airflow path extends between the dirty air inlet 108 and the dirty air outlet 112. When connected to a vacuum cleaner (not shown) that generates suction to separate dirt and debris from an airstream, the suction within the dirty airflow path is constantly changing during operation and depends largely on what type of surface (e.g., hard floors, plush carpet, etc.) the dirty air inlet 108 is in contact with (see FIG. 5). When the negative differential pressure between the dirty airflow path and atmospheric pressure (i.e., suction level within the dirty airflow path) becomes too large it becomes difficult for a user to push the surface cleaning head 100 across the surface to be cleaned, and when the suction within the dirty airflow path becomes too small there is not enough suction at the dirty air inlet 108 to pick debris up off the surface to be cleaned. In the illustrated embodiment, an automated valve assembly 116 is positioned on the housing 104 above the surface to be cleaned, and the automated valve assembly 116 is operable to open and place the dirty airflow path in fluid communication with ambient pressure outside the housing 104 (e.g., an air bleed). More specifically, the automated valve assembly 116 includes an opening to fluidly communicate the dirty airflow path with ambient pressure, and the opening is positioned above the surface to be cleaned. The automated valve assembly 116 is adjustably opened (i.e., opened to varying degrees, rather than a single, binary open and closed) based upon the suction within the dirty airflow path. As described in further detail below, the automated valve assembly 116 selectively communicates the dirty airflow path with ambient pressure to continuously adjust the suction within the dirty airflow path.

Figure 5:
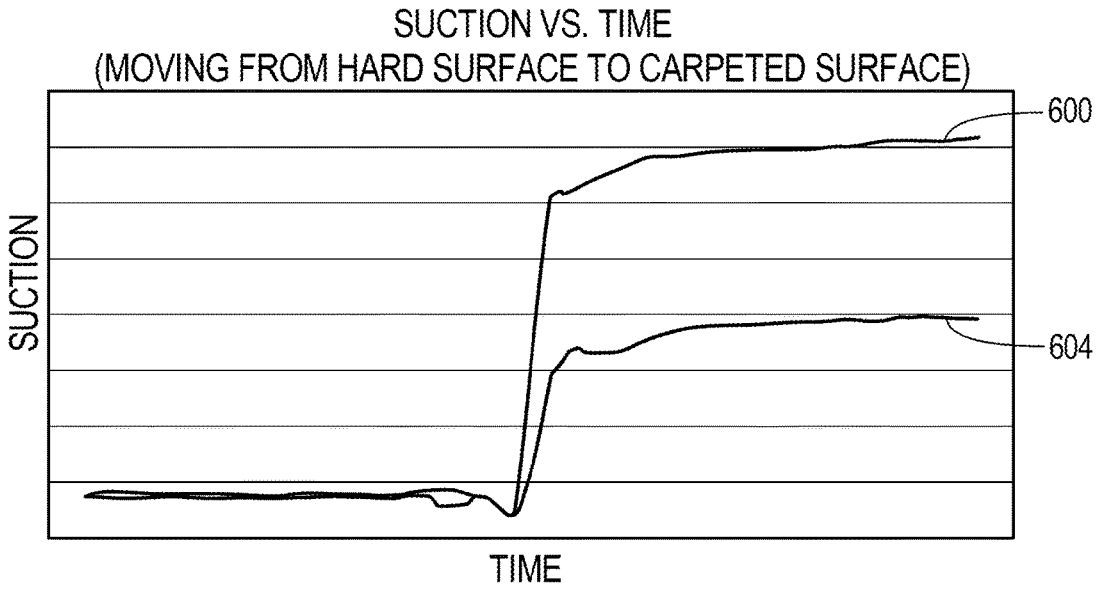
FIG. 5 is a graph of suction levels within a dirty airflow path as a function of time as a conventional surface cleaning head transitions from a hard surface to different carpeted surfaces.

With reference to FIG. 5, a graph illustrates the suction (i.e., negative differential pressure) measured within the dirty airflow path of a conventional surface cleaning head as it travels from a hard surface (e.g., wood floor, linoleum floor, etc.) to a carpeted surface. The two plotted curves illustrate the conventional surface cleaning head transitioning to two different types of carpeted surface. The first curve 600 illustrates the conventional surface cleaning head transitioning to a plush carpet, and the second curve 604 illustrates the conventional surface cleaning head transitioning to a multi-fiber carpet. As clearly seen from FIG. 5, the suction generated in the dirty airflow path when the conventional surface cleaning head is on the plush carpet is larger than when the surface cleaning head is on the multi-fiber carpet. In some cases, the suction generated in the dirty airflow path as the conventional surface cleaning head transitions off of the hard surface can increase around 400% (for multi-fiber carpet) to around 600% (for plush carpet). As discussed previously, it is desirable to maintain the suction in the dirty airflow path to within a desired range of suction. The variability of the suction within the dirty airflow path of a conventional surface cleaning head as shown in FIG. 5 is outside a desirable range of suctions. In other words, the suction ranges too widely with not enough suction on the hard surface and too much suction on the plush carpet. It is typically desired to maintain suction below approximately 7 inches of water. For certain floor types, the desired range of suction can be between approximately 3 inches of water and approximately 6 inches of water. For other floor types, the desired range of suction can be between approximately 4 inches of water and 7 inches of water. Other ranges are contemplated for various floor surfaces. This problem highlights the need for an automated valve assembly, according to the invention, which automatically keeps the dirty airflow path within a desired range of suction when the surface cleaning head is cleaning both hard and carpeted surfaces.

With continued reference to FIG. 1, the automated valve assembly 116 includes a plurality of valves 120 positioned between and selectively connecting the dirty airflow path and ambient pressure. Each of the plurality of valves 120 is configured to automatically open in response to a certain suction existing within the dirty airflow path. In the illustrated embodiment, the plurality of valves 120 open sequentially as the suction within the dirty airflow path continues to increase. More specifically, the plurality of valves 120 includes a first valve 120A and a second valve 120B that are both configured to place the dirty airflow path in fluid communication with ambient pressure (i.e., open). The first valve 120A opens in response to a first suction level existing within the dirty airflow path, and the second valve 120B opens in response to a second suction level existing within the dirty airflow path. The second suction level is larger in magnitude than the first suction level. In other words, each of the plurality of valves 120 automatically places the dirty airflow path in fluid communication with ambient pressure in response to a different suction level existing within the dirty airflow path. The plurality of valves 120 do not all open simultaneously, but rather sequentially open as the suction within the dirty airflow path increases. In this sense, the automated valve assembly 116 automatically adjusts to keep the dirty airflow path within a desired range of suction.

The plurality of valves 120 may be any suitable type of valves that automatically open in response to a pressure differential. For example, the plurality of valves 120 may be diaphragm valves, spring valves, poppet valves, umbrella valves, etc., or some combination thereof. In the case of diaphragm valves, each of the plurality of diaphragm valves includes a diaphragm that opens in response to a different suction within the dirty airflow path. In the case of spring valves, each of the plurality of spring valves includes a spring having a different spring constant that causes each of the spring valves to open in response to a different suction within the dirty airflow path. Although the illustrated embodiment shows eight valves 120, any number of valves may be used in alternative embodiments.

Figure 6:
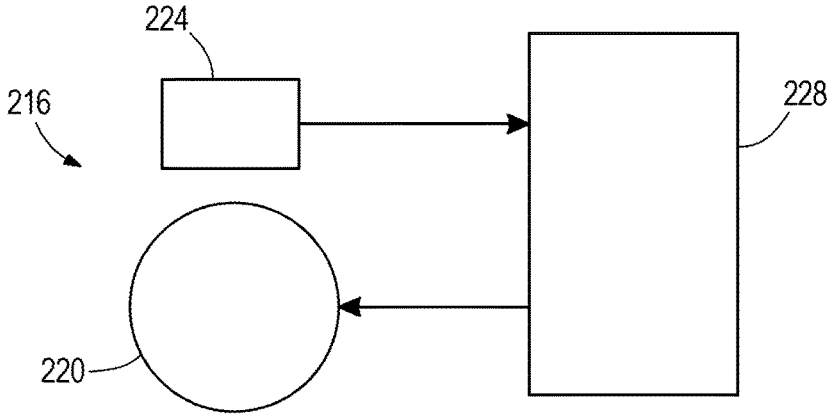
FIG. 6 is a schematic of an automated valve assembly according to one aspect of the invention.

With reference to FIG. 6, an automated valve assembly 216 according to another embodiment is schematically illustrated. The automated valve assembly 216 includes an adjustable valve 220, a sensor 224 operable to measure the suction within the dirty airflow path, and a controller 228 operable to control the adjustable valve 220 based on the sensor 224 measurement. The adjustable valve 220 can be incrementally opened or closed to allow an adjustable amount of airflow in fluid communication with the dirty airflow path. For example, the adjustable valve 220 can be opened in increasing amounts when the suction within the dirty airflow path increases in magnitude. The sensor 224 can be positioned within the dirty airflow path, or as an alternative, the sensor 224 can be positioned separately from the dirty airflow path with a separate measuring airflow path extending between the sensor 224 and the dirty airflow path. The controller 228 may be any type of suitable microcontroller, microprocessor, etc., and the controller 228 operates the adjustable valve 220 to keep the dirty airflow path within a desired range of suction using the sensor 224 measurement feedback. In this sense, the automated valve assembly 216 automatically adjusts to keep the dirty airflow path within a desired range of suction. The controller 228 can operate the adjustable valve 220 by, for example, manipulating the direct energizing of the valve 220 or by energizing an intermediate actuator that manipulates the valve.

Figure 2:
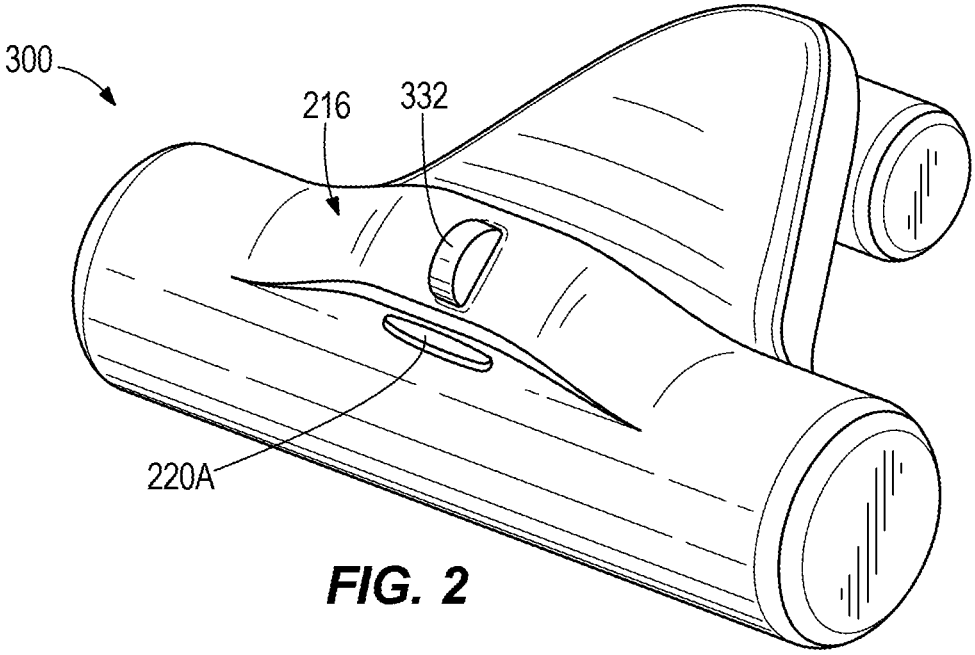
FIG. 2 is a perspective view of a surface cleaning head according to another aspect of the invention.
Figure 3:
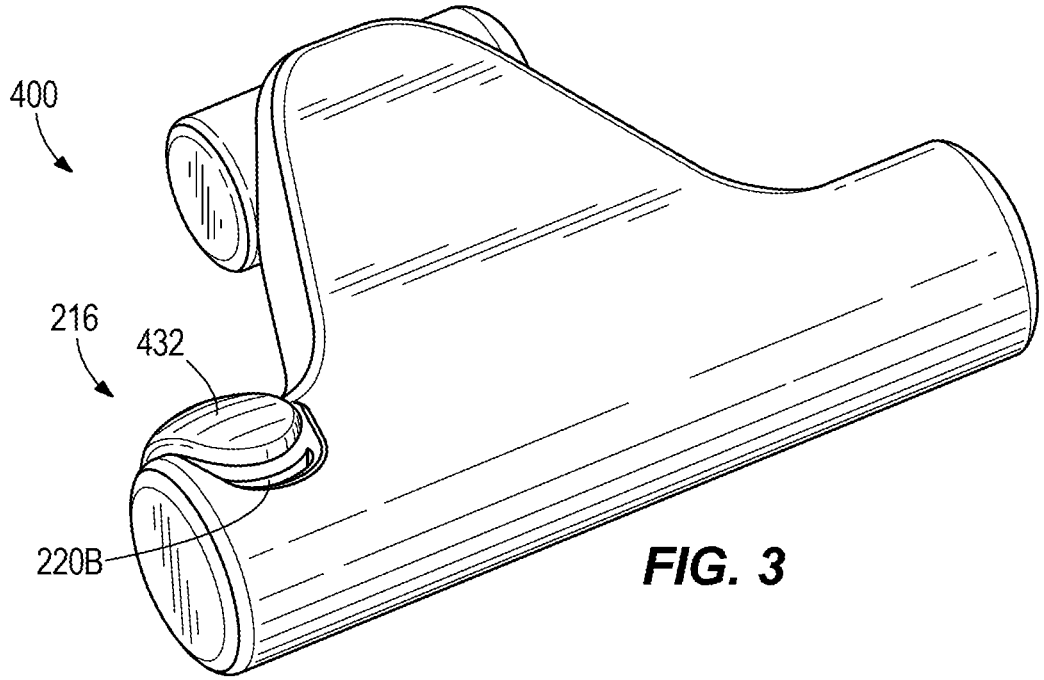
FIG. 3 is a perspective view of a surface cleaning head according to another aspect of the invention.
Figure 4:
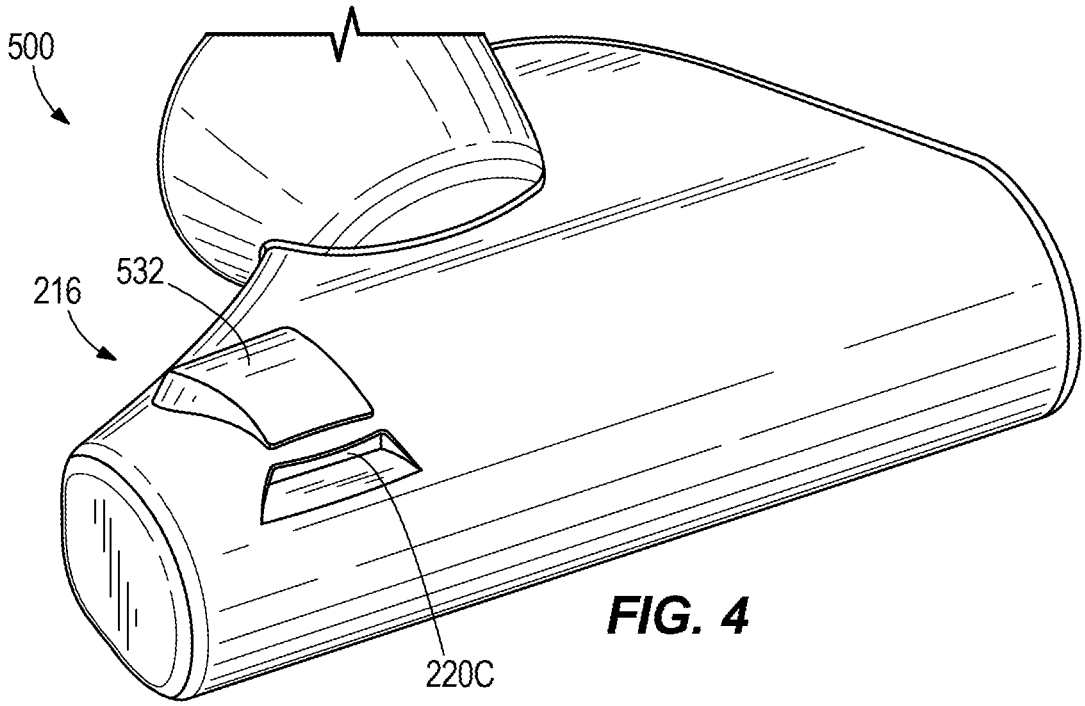
FIG. 4 is a perspective view of a surface cleaning head according to another aspect of the invention.

With reference to FIGS. 2-4, surface cleaning heads 300, 400, and 500 according to various embodiments of the invention are illustrated. Each of the surface cleaning heads 300, 400, and 500 illustrated include an automated valve assembly 216 with an adjustable valve 220A, 220B, 220C that is both operable by a user to manually adjust and is automatically adjustable via the controller 228. The surface cleaning head 300 includes a manual slide 332 to adjust the adjustable valve 220A, the surface cleaning head 400 includes a manual dial 432 to adjust the adjustable valve 220B, and the surface cleaning head 500 includes a manual lever 532 to adjust the adjustable valve 220C. In addition to the manual inputs 332, 432, 532, the extent to which the adjustable valves 220A-C are opened can be controlled by the controller 228 via, for example, an intermediate actuator (not shown). In the illustrated embodiments, actuation of the manual input 332, 432, 532 by the user would override the automated setting of the adjustable valve 220A-C by the controller 228.

Although the automated valve assemblies 116, 216 may be positioned in various locations on the surface cleaning apparatus, it is preferred that the automated valve assemblies 116, 216 be located above the surface to be cleaned and on a top surface cleaning head housing. In this way, the adjustable valve assemblies 116, 216 are readily accessible by the user, and are spatially removed from the dirty air inlet. Positioning the automated valve assembly away from the dirty air inlet mitigates the risk of a foreign object that is blocking the dirty air inlet to also block the automated valve assembly. In other words, if a valve was positioned near or adjacent to the dirty air inlet and an object was to block the dirty air inlet, that object would also likely block the valve. Additionally or alternatively, the adjustable valve assemblies 116, 216 are positioned within an above floor surface cleaning head (e.g., an above floor cleaning wand) to regulate the suction levels within the above floor surface cleaning head.

Although the invention has been described in detail with reference to certain preferred embodiments, variations and modifications exist within the scope and spirit of one or more independent aspects of the invention as described.

What is claimed is:

1. A surface cleaning head for a surface cleaning apparatus comprising:

a dirty air inlet;

a dirty air outlet;

a dirty airflow path extending between the dirty air inlet and the dirty air outlet; and an automated valve assembly operable to open and place the dirty airflow path in fluid communication with ambient pressure, wherein the automated valve assembly is adjustably opened based upon a suction level within the dirty airflow path, wherein the automated valve assembly includes a plurality of valves positioned between the dirty airflow path and ambient pressure operable to sequentially open as the suction within the dirty airflow path increases.

2. The surface cleaning head of claim 1, wherein the plurality of valves are diaphragm valves.

3. The surface cleaning head of claim 2, wherein each of the plurality of diaphragm valves include a diaphragm that opens in response to a different suction level within the dirty airflow path.

4. The surface cleaning head of claim 2, wherein the plurality of valves are spring valves.

5. The surface cleaning head of claim 4, wherein each of the plurality of spring valves include a spring having a different spring constant that causes each of the spring valves to open in response to a different suction level within the dirty airflow path.

6. The surface cleaning head of claim 2, wherein the plurality of valves includes a first valve that places the dirty airflow path in fluid communication with ambient pressure in response to a first suction level within the dirty airflow path, and the plurality of valves includes a second valve that places the dirty airflow path in fluid communication with ambient pressure in response to a second suction level within the dirty airflow path, the second suction level larger in magnitude that the first suction level.

7. The surface cleaning head of claim 2, wherein each of the plurality of valves automatically places the dirty airflow path in fluid communication with ambient pressure in response to a different suction level within the dirty airflow path.

8. The surface cleaning head of claim 2, wherein the plurality of valves do not all open simultaneously.

9. The surface cleaning head of claim 1, wherein the automated valve assembly includes an opening to fluidly communicate the dirty airflow path with ambient pressure, and wherein the opening is positioned above the surface to be cleaned.

10. The surface cleaning head of claim 1, wherein the automated valve assembly automatically adjusts to keep the dirty airflow path within a desired range of suction.

11. The surface cleaning head of claim 10, wherein the automated valve assembly keeps the dirty airflow path within the desired range of suction when the surface cleaning head is cleaning a hard surface and a carpeted surface.

* * * * *